US008592357B2

(12) United States Patent
Thoen et al.

(10) Patent No.: US 8,592,357 B2
(45) **Date of Patent: *Nov. 26, 2013**

(54) POLYALKYLENE GLYCOL LUBRICANT COMPOSITION

(71) Applicant: Dow Global Technologies LLC, Midland, MI (US)

(72) Inventors: Johan A. Thoen, Antwerp (BE); Mathias Woydt, Berlin (DE); Daniel F. Zweifel, Hirzel (CH)

(73) Assignee: Dow Global Technologies LLC, Midland, MI (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/715,078

(22) Filed: Dec. 14, 2012

(65) Prior Publication Data

US 2013/0102507 A1 Apr. 25, 2013

Related U.S. Application Data

(63) Continuation of application No. 12/988,871, filed as application No. PCT/US2009/041800 on Apr. 27, 2009, now Pat. No. 8,357,644.

(60) Provisional application No. 61/125,701, filed on Apr. 28, 2008.

(51) Int. Cl.

| | |
|---|---|
| ***C10M 107/34*** | (2006.01) |
| ***C10M 129/34*** | (2006.01) |
| ***C10M 129/72*** | (2006.01) |
| ***C10M 133/00*** | (2006.01) |

(52) U.S. Cl.
USPC ..... 508/579; 508/476; 508/508

(58) Field of Classification Search
USPC ..... 508/579, 476, 508
See application file for complete search history.

(56) References Cited

U.S. PATENT DOCUMENTS

| | | | | |
|---|---|---|---|---|
| 2,674,619 | A | 4/1954 | Lundsted | |
| 2,733,272 | A | 1/1956 | Horsley et al. | |
| 2,831,034 | A | 4/1958 | Pruitt et al. | |
| 2,948,575 | A | 8/1960 | Kallman et al. | |
| 3,036,118 | A | 5/1962 | Jackson et al. | |
| 4,218,328 | A * | 8/1980 | Vaughan | 508/287 |
| 4,855,070 | A | 8/1989 | Lewis | |
| 5,143,640 | A * | 9/1992 | Moxey | 508/580 |
| 5,275,749 | A * | 1/1994 | Kugel et al. | 508/375 |
| 5,342,531 | A * | 8/1994 | Walters et al. | 508/272 |
| 5,531,937 | A | 7/1996 | Minevski et al. | |
| 6,165,951 | A * | 12/2000 | Leonhardt | 508/437 |
| 6,194,359 | B1 | 2/2001 | Beyer et al. | |
| 6,436,883 | B1 * | 8/2002 | Nieh | 508/579 |
| 6,465,399 | B2 * | 10/2002 | Koishikawa et al. | 508/416 |
| 6,844,068 | B1 | 1/2005 | Miyake et al. | |
| 6,913,707 | B2 * | 7/2005 | Woydt et al. | 252/68 |
| 7,179,769 | B2 | 2/2007 | Sunkara | |
| 7,741,259 | B2 * | 6/2010 | da Costa | 508/579 |
| 7,951,756 | B2 | 5/2011 | Konishi et al. | |
| 8,357,644 | B2 * | 1/2013 | Thoen et al. | 508/579 |
| 2004/0094743 | A1 | 5/2004 | Woydt et al. | |
| 2005/0256014 | A1 | 11/2005 | Sherman et al. | |
| 2007/0004606 | A1 * | 1/2007 | da Costa | 508/579 |
| 2008/0312113 | A1 * | 12/2008 | Beatty et al. | 508/162 |
| 2010/0204075 | A1 * | 8/2010 | da Costa | 508/579 |

FOREIGN PATENT DOCUMENTS

| | | | |
|---|---|---|---|
| DE | 19605162 | C1 | 9/1997 |
| DE | 19820883 | A1 | 11/1999 |
| DE | 102005011776 | A1 | 9/2006 |
| DE | 102005041909 | A1 | 3/2007 |
| EP | 0355977 | A1 | 2/1990 |
| EP | 0574651 | A1 | 12/1993 |
| EP | 0578449 | A1 | 1/1994 |
| EP | 1046699 | A1 | 10/2000 |
| FR | 2792325 | A1 | 10/2000 |
| FR | 2817874 | B1 | 2/2005 |
| WO | 9603644 | A1 | 2/1996 |

OTHER PUBLICATIONS

Van Voorst, "Polyglycols as Base Fluids for Environmentally-Friendly Lubricants", Journal of Synthetic Lubrication, 2000, vol. 16, No. 4, pp. 313-322, Leaf Coppin Publishing Ltd.

National Industrial Chemical Notification and Assessment Scheme (NICNAS)—Full Public Report—Desmophen NH 1420, (Jul. 2, 2007), XP55011270.

* cited by examiner

*Primary Examiner* — Ellen McAvoy
(74) *Attorney, Agent, or Firm* — Raef Shaltout

(57) ABSTRACT

A lubricant composition useful for automotive engines, comprising: (A) at least one polyalkylene glycol suitable for use as a lubricant in an automotive engine, (B) an additive package which comprises an acid scavenger, wherein the acid scavenger is an aspartic acid ester, aspartic acid amide, a Group V aspartic acid salt, or a combination thereof.

7 Claims, No Drawings

POLYALKYLENE GLYCOL LUBRICANT COMPOSITION

This application is a continuation of U.S. application Ser. No. 12/988,871, filed Oct. 21, 2010, which is a §371 application of PCT International Patent Application Number PCT/US2009/041800 filed Apr. 27, 2009, which claims priority from provisional application Ser. No. 61/125,701 filed Apr. 28, 2008, each of which is incorporated herein by reference in its entirety.

This invention pertains to a polyalkylene glycol (PAG) lubricant composition containing an amide or ester derivative of aspartic acid, or a Group V salt of an aspartic acid.

Engine lubricant oils are composed of base oils and additives. Certain synthetic oils, such as PAGs, are characterized by inherent low friction properties and good low and high temperature viscosity properties which promote excellent hydrodynamic film formation between moving parts.

PAG-based engine lubricant oils find an increasing original equipment manufacturer (OEM) interest due to their intrinsic properties in relation to an increasing number of new performance criteria requested by automotive engine design departments.

A need exists for additive packages which are soluble in PAGs, preferably where the package itself meets certain bio-no-tox criteria or will not deteriorate biological and toxicological ("bio-no-tox") properties of a base oil below criteria set forth in, for example, European Community directive EC/1999/45, and which are adapted to the specific chemistry and oxidation kinetics of PAGs in order to meet critical application performance requirements for use in internal combustion engine oils and exceed those known from hydrocarbons. The criteria in directive EC/1999/45 are incorporated herein by reference as the criteria for determining whether an additive package is in accordance with this invention.

In one aspect or embodiment, this invention is a lubricant composition useful for automotive engines, comprising: (A) at least one PAG suitable for use as a lubricant in an automotive engine, and (B) an additive package which comprises an acid scavenger, wherein the acid scavenger is an aspartic acid ester, an aspartic acid amide, a Group V salt of aspartic acid, or a combination thereof.

The lubricant composition may contain additional components and have certain properties including but not limited to compositions wherein: the additive package further comprises (i) at least (≥) one extreme pressure anti-wear additive, (ii) ≥one anti-corrosion additive, (iii) ≥one antioxidant, (iv) ≥one friction modifier, (v) ≥one additional acid scavenger, or any combination of (i)-(v); the additive package is soluble at 25 degrees Centigrade (° C.) in the PAG; the additive package meets bio-no-tox criteria of EC/1999/45 and preferably does not deteriorate the bio-no-tox properties of the PAG (also known as "lubricant oil base stock) below (does not pass) the EC/1999/45 criteria; the composition excludes additives that do not meet the EC/1999/45 bio-no-tox criteria or will deteriorate the bio-no-tox properties of the lubricant oil base stock; the additive package includes≥one thickening agent; the additive package includes≥one detergent is included; and combinations thereof.

In another aspect, this invention is a method of lubricating an automobile engine, comprising: employing the above lubricant composition as a lubricant oil.

Lubricating oil base stocks used in formulating lubricant compositions of this invention are composed primarily or exclusively of PAGs of lubricating viscosity. A wide variety of such oleaginous liquids are available as articles of commerce. Normally the PAG has a viscosity at 40° C. within a range of from 20 centistokes (cSt) (20 square millimeters per second ($mm^2/s$)) to 10,000 cSt (10,000 $mm^2/s$) and a viscosity within a range of from 3 cSt (3 $mm^2/s$) to 2,000 cSt (2,000 $mm^2/s$) at 100° C. The base stocks preferably meet EC/1999/45 bio-no-tox criteria.

Suitable PAGs include, but are not limited to, a reaction product of a 1,2-oxide (vicinal epoxide) with water, or an alcohol, or an aliphatic polyhydric alcohol containing from 2 hydroxyl groups to 6 hydroxyl groups and between 2 carbon atoms ($C_2$) and 8 carbon atoms ($C_8$) per molecule. Suitable compounds useful in preparing these PAGs include lower ($C_2$ to $C_8$) alkylene oxides, such as ethylene oxide, propylene oxide, butylene oxide, cyclohexene oxide, and glycidol. Mixtures of these 1,2-oxides are also useful in preparing PAGs. A PAG may be formed by known techniques in which an aliphatic polyhydric alcohol or water or monohydric alcohol (often called an "initiator") is reacted with a single 1,2-oxide or a mixture of two or more of the 1,2-oxides. If desired, the initiator may be first oxyalkylated with one 1,2-oxide, followed by oxyalkylation with a different 1,2-oxide or a mixture of 1,2-oxides. The oxyalkylated initiator can be further oxyalkylated with a still different 1,2-oxide.

For convenience, "mixture," when applied to a PAG containing a mixture of 1,2-oxides, includes both random and/or block polyethers such as those prepared by: (1) random addition obtained by simultaneously reacting two or more 1,2-oxides with the initiator; (2) block addition in which the initiator reacts first with one 1,2-oxide and then with a second 1,2-oxide, and (3) block addition in which the initiator first reacts with a first 1,2-oxide followed by random addition wherein the initiator reacts with a combination of the first 1,2-oxide and a second 1,2-oxide.

Any suitable ratio of different 1,2-oxides may be employed. When a mixture of ethylene oxide (EO) and propylene oxide (PO) is utilized to form polyethers by random and/or block addition, the proportion of EO is generally between 3 weight percent (wt percent) and 60 wt percent, and preferably between 5 wt percent and 50 wt percent, based on total mixture weight.

Aliphatic polyhydric alcohol reactants used in making the PAG include those containing between from two hydroxyl (OH) groups to six OH groups and from two carbon atoms ($C_2$) to eight carbon atoms ($C_8$) per molecule, as illustrated by compounds such as: ethylene glycol, propylene glycol, 2,3-butylene glycol, 1,3-butylene glycol, 1,4-butanediol, 1,3-propanediol, 1,5-pentane diol, 1,6-hexene diol, glycerol, trimethylolpropane, sorbitol, pentaerythritol, mixtures thereof and the like. Cyclic aliphatic polyhydric compounds such as starch, glucose, sucrose, and methyl glucoside may also be employed in PAG preparation. Each of the aforesaid polyhydric compounds and alcohols can be oxyalkylated with EO, PO, butylene oxide (BO), cyclohexene oxide, glycidol, or mixtures thereof. For example, glycerol is first oxyalkylated with PO and the resulting PAG is then oxyalkylated with EO. Alternatively, glycerol is reacted with EO and the resulting PAG is reacted with PO and EO. Each of the above-mentioned polyhydric compounds can be reacted with mixtures of EO and PO or any two or more of any of the aforesaid 1,2-oxides, in the same manner. Techniques for preparing suitable polyethers from mixed 1,2-oxides are shown in U.S. Pat. Nos. 2,674,619; 2,733,272; 2,831,034, 2,948,575; and 3,036,118. The starting materials can be derived from naturally occurring materials, such as PO derived from monopropylene glycol (MPG) based on glycerin or EO derived from ethanol or tetrahydrofuran derived from hemicellulose. Likewise, polyglycolesters can be made from renewable esters, such as vegetable oils or oleic sunflower oils, canola oil, soy oil, their respective high oleic products, as well as castor oil, lesquerella oil, jathropa oil, and their derivatives.

Monohydric alcohols typically used as initiators include the lower acyclic alcohols such as methanol, ethanol, propanol, butanol, pentanol, hexanol, neopentanol, isobutanol, decanol, and the like, as well as higher acyclic alcohols derived from both natural and petrochemical sources with from 11 carbon atoms to 22 carbon atoms. As noted above, water can also be used as an initiator.

Preferred PAGs for use in this invention include PAGs produced by the polymerization of EO and PO onto an initiator.

The lubricant oil base stock may contain an amount, preferably a minor (less than 50 wt percent based upon total lubricant oil base stock weight) amount of other types of lubricating oils, such as vegetable oils, mineral oils, and synthetic lubricants such as polyesters, alkylaromatics, polyethers, hydrogenated or unhydrogenated poly-alpha-olefins and similar substances of lubricating viscosity.

In an embodiment, one or more lubricant oil (preferably PAG) base stocks may be of formula:

$$R—[X—(CH_2CH_2O)_n(C_yH_{2y}O)_p—Z]_m$$

where R is H or an alkyl or an alkyl-phenyl group having from 1 carbon atom to 30 carbon atoms; X is O, S, or N; y is a single or combined integer from 3 to 30; Z is H or a hydrocarbyl or hydrocarboxyl group containing from 1 carbon atom to 30 carbon atoms; n+p is from 6 to 60 and the distribution of n and p can be random or in any specific sequence; m is 1 to 8; and polyether molecular weight is from 350 Daltons to 3,500 Daltons. PAGs used in compositions of this invention can include capped materials where existing OH functionality is converted to an ether group.

A variety of PAG products for engine and gear oil applications are currently available commercially, including but not limited to those products sold under the following brand names: PLURIOL™ A750E; PLURACOL™ WS55, WS100, WS170, B11/25, B11/50, B32/50; BREOX™ A299; BREOX™ 50A; PPG-33- series; UCON™ 50-HB series; SYNALOX™ 50-xxB series; SYNALOX™ 100-xxB series; GLYGOYLE™ HE460; D21/150; PLURONIC™ 450PR, PLURONIC™ 600PR; TERRALOX™ WA46, TERRALOX™ WA110; SYNALOX™ 40-D150; Polyglycol B01/20, B01/40, B01/50, B15, B35; UCON LB65, LB125, LB165, LB285, W1285, W1625; P41/200; PLURONIC™ GENAPOL™; WAKO T01/15, T01/35, T01/60; LUPRANOL™ 9209 and 3300; and SELEXOL™.

The additive package and each of its components preferably meet EC/1999/45 bio-no-tox criteria and, more preferably, do not deteriorate performance lubricant oil base stocks below (that is, does not pass) the EC/1999/45 bio-no-tox criteria. The additive package and each of its components more preferably are soluble in the lubricant oil base stock, either at room temperature (nominally 25 degrees centigrade (° C.) or at an elevated temperature.

Esters and amides, and Group V (of The Periodic Table of the Elements) salts, of aspartic acid (collectively "aspartic acid derivatives") are employed in the practice of this invention as a required lubricant composition component. Compounds used to form the esters and amides may include from 1 carbon atom to 25 carbon atoms, more typically from 1 carbon atom to 6 carbon atoms. For example, the carboxylic acid groups can be converted to methyl or ethyl esters (or a mixture thereof). One or both of the carboxylic acid groups of each aspartic acid functional group in the additive of this invention may be reacted to form such esters, amides, and Group V salts. Typically all the carboxylic acid groups are reacted to form such esters, amides, and Group V salts for acid scavengers used in various aspects or embodiments of this invention. The amount of such aspartic acid derivatives may vary. In general the amount is from 0.01 wt percent to 10 wt percent based on the total weight of the lubricant composition. More typically the amount is from 0.1 wt percent to 1 wt percent. Materials used to react with aspartic acid to form aspartic acid derivatives include compounds such as ammonia and other Group V compounds including ammonium, phosphonium, arsonium, and antimonium based materials, amines such as $C_1$-$C_{50}$ aliphatic amines such as methyl amine, ethyl amine, propyl amine, and butyl amine. The Group V salts appear to be superior to Group 1A cationic salts in terms of improved corrosion properties of the lubricant compositions. In addition, the Group V salts have improved solubility, relative to Group 1A salts, in PAG-based lubricant oil base stocks. The aspartic acid additives used herein include mono-acids and poly-acids (for example, those containing two or more aspartic acid functional groups ("polyaspartic acids")).

Aspartic acid and polyaspartic acid refer to compounds that contain one or more aspartic acid groups. Typically the additives used herein contain≥two aspartic acid groups. Aspartic acid esters, amides, and Group V salts include compositions based on the following formula:

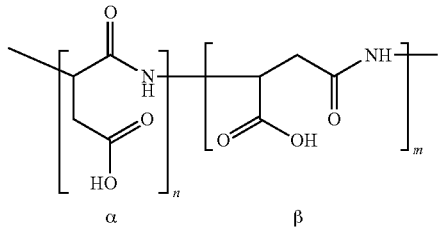

Poly-α, β-D,L-aspartate

In the formula above, which describes a homo-polymer of aspartic acid, carboxylic acid groups or moieties can be converted to any of esters, amides, and Group V salts.

Polyaspartic acid compounds can be based on any organic structure which includes multiple aspartic acid groups attached thereto such as compounds of the following formula:

A-X-A wherein A is aspartic acid ester, amide, or Group V salt, and X is a divalent $C_2$-$C_{25}$ hydrocarbon moiety. X may include additional elements such as oxygen, nitrogen, and sulfur. X can be a divalent alkane group, aliphatic group, or aromatic group, including alkane groups and aliphatic groups containing cyclic structures. X can also be based on di-cyclohexyl methane. Typically a nitrogen atom of aspartic acid forms a bond with a divalent hydrocarbon moiety. An exemplary polyaspartic acid compound has the following structure:

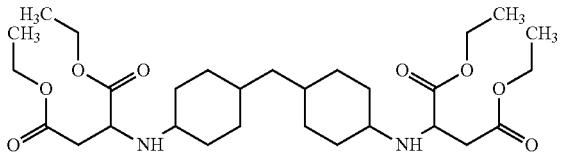

which is aspartic acid N,N'-(methylene-d-4,1,-cyclohexanediyl)bis-tetraethyl ester. This polyaspartic acid ester appears to correspond to DESMOPHEN™ NH1420 polyaspartic polyamino co-reactant (Bayer MaterialScience) and K-CORR™ 100 (King Industries).

The extreme pressure and anti-wear additives can be any conventional material so long as it meets the above EC/1999/45 bio-no-tox and solubility performance requirements. Representative examples of extreme pressure and anti-wear additives include, but are not limited to, dialkyl-dithio-carbamates of metals and methylene, esters of polyaspartic acid, triphenyl-thio-phosphates, diaryldisulfides, dialkyldisulfides, alkylarylsulfides, dibenzyldisulphide, and combinations thereof. Representative examples of preferred extreme pressure and anti-wear additives include, but are not limited to, dibenzyldisulfide (US FDA approved), O,O,O-triphenylphosphorothioate, Zn-di-n-butyldithiocarbamate, Mo-dibutyldithiocarbamate, and Zn-methylene-bis-dialkyldithiocarbamate, with dibenzyldisulfide being especially preferred. Representative examples of commercially available anti-wear additives that can be employed in the practice of this invention include but are not limited to IRGALUBE™ 63, 211, 232, and 353 (isopropylated triaryl phosphates); IRGALUBE™ 211 and 232 (nonylated triphenyl phosphorothionates); IRGALUBE™ 349 (amine phosphate); IRGALUBE™ 353 (dithiophosphate); IRGAFOS™ DDPP (isodecyl diphenyl phosphite); and IRGAFOS™ OPH (di-n-octyl-phosphite).

The anti-corrosion additive (also known as a "metal deactivator") may be any single compound or mixture of compounds that inhibits corrosion of metallic surfaces. The corrosion inhibitor can be any conventional material so long as it meets the above EC/1999/45 bio-no-tox and solubility performance requirements. Representative anti-corrosion additives include thiadiazoles and triazoles such as tolyltriazole; dimer and trimer acids such as those produced from tall oil fatty acids, oleic acid, and linoleic acid; alkenyl succinic acid and alkenyl succinic anhydride corrosion inhibitors such as tetrapropenylsuccinic acid, tetrapropenylsuccinic anhydride, dodecenylsuccinic acid, dodecenylsuccinic anhydride, hexadecenylsuccinic acid, and similar compounds; and half esters of $C_8$-$C_{24}$ alkenyl succinic acids with alcohols such as diols and polyglycols. Also useful are aminosuccinic acids or derivatives thereof. Preferred anti-corrosion additives include, but are not limited to, morpholine, N-methyl morpholine, N-ethyl morpholine, amino ethyl piperazine, monoethanol amine, 2 amino-2-methylpropanol (AMP), liquid tolutriazol derivatives such as 2,2'-methyl-1H-benzotriazol-1-yl-methyl-imino-bis and methyl-1H-benzotriazol, isopropyl hydroxylamine, IRGAMET™ 30 (liquid tolutriazol derivative), IRGAMET™ 30 (liquid triazol derivative), IRGAMET™ SBT 75 (tetrahydrobenzotriazole), IRGAMET™ 42 (tolutirazole derivative), IRGAMET™ BTZ (benzotriazole), IRGAMET™ TTZ (tolutriazole), imidazoline and its derivatives, IRGACOR™ DC11 (undecanedioic acid), IRGACOR™ DC 12 (dodecanedioic acid), IRGACOR™ L 184 (TEA neutralized polycarboxylic acid), IRGACOR™ L 190 (polycarboxylic acid), IRGACOR™ L12 (succinic acid ester), IRGACOR™ DSS G (n-oleyl sarcosine), and IRGACOR™ NPA (iso-nonyl phenoxy acetic acid). The lubricant composition preferably contains from 0.005 wt percent to 0.5 wt percent, and more preferably from 0.01 wt percent to 0.2 wt percent, of anti-corrosion additive, each wt percent being based upon total lubricant composition weight.

The antioxidant(s) can be any conventional antioxidant so long as it meets the above EC/1999/45 bio-no-tox and solubility performance requirements. The antioxidant can vary widely, including compounds from classes such as amines and phenolics. The antioxidant can include a sterically hindered phenolic antioxidant (for example, an ortho-alkylated phenolic compound such as 2,6-di-tert-butylphenol, 4-methyl-2,6-di-tert-butylphenol, 2,4,6-tri-tert-butylphenol, 2-tert-butylphenol, 2,6-di-isopropylphenol, 2-methyl-6-tert-butylphenol, 2,4-dimethyl-6-tert-butylphenol, 4-(N,N-dimethylaminomethyl)-2,6-di-tert-butylphenol, 4-ethyl-2,6-di-tert-butylphenol, 2-methyl-6-styrylphenol, 2,6-di-styryl-4-nonylphenol, and their analogs and homologs). Representative examples of preferred antioxidants include, but are not limited to, amine antioxidants such as N-phenyl-1-naphthylamine N-phenylbenzenamine reaction products with 2,4,4-trimethylpentenes; phenothizines such as dibenzo-1,4,thiazine, 1,2-dihydroquinoline and poly(2,2,4-trimethyl-1,2-dihydroquinoline). Representative examples of commercially available and suitable antioxidants include, but are not limited to, IRGANOX™ L01, L06, L57, L93 (alkylated diphenyl amines and alkylated phenyl-naphtyl amines); IRGANOX™ L101, L107, L109, L115, L118, L135 (hindered phenolic antioxidants); IRGANOX™ L64, L74, L94, L134, and L150 (antioxidant blends); IRGFOS™ 168 (di-tert-butyl phenyl phosphate); IRGANOX™ E201 (alpha-tocopherol), and IRGANOX™ L93 (sulfur-containing aromatic amine antioxidant). The lubricant composition preferably contains from 0.01 wt percent to 1.0 wt percent, more preferably from 0.05 wt percent to 0.7 wt percent, of such antioxidant(s), each wt percent being based on total lubricant composition weight.

The additional acid scavenger is a single compound or a mixture of compounds that has an ability to scavenge acids. The acid scavenger can be any conventional material so long as it meets the above EC/1999/45 bio-no-tox and solubility performance requirements. Representative acid scavengers include, but are not limited to, sterically hindered carbodiimides, such as those disclosed in FR 2,792,326, incorporated herein by reference.

The friction (rheology) modifier can be any conventional material so long as it meets the above EC/1999/45 bio-no-tox and solubility performance requirements. A representative non-limiting example of such a material is a copolymer of diphenylmethane-diisocyanate hexamethylene diamine and sterarylamine (for example, LUVODUR™ PVU-A). The lubricating compositions preferably contain from 0.01 wt percent to 1.0 wt percent, more preferably from 0.05 wt percent to 0.7 wt percent, of such friction modifiers, each wt percent being based on total lubricant composition weight.

The lubricant compositions optionally contain small amounts of a demulsifier and/or an antifoam agent. Such demulsifiers include organic sulphonates and oxyalkylated phenolic resins. Various antifoam agents are well known in the art, such as stearylamine, silicones and organic polymers such as acrylate polymers. If present, such additives typically comprise, on an individual basis, no more than 1 wt percent based on total lubricant composition weight. The lubricant compositions also optionally contain a thickening agent such as a polyethylene oxide, a polyacrylate, a styrene-acrylate latex, a styrene butadiene latex, and a polyurethane prepolymer. The thickening agent when present, is used in an amount sufficient to provide the lubricant composition with a desired thickness or viscosity.

Prepare the lubricant compositions by simple addition of the components and mixing. This can occur at room temperature (nominally 25° C.). Higher temperatures of up to, for example, 170° C., may be employed to effect solubilization of the additives into the lubricant oil (preferably PAG) base stock. One may effect mixing ultrasonically or by using a high speed dispergator.

The lubricant compositions have utility as lubricants for automobile engines.

Examples that follow illustrate the invention, but do not limit its scope or that of any claims appended hereto. Unless otherwise noted, all percentages are by weight.

Table 1 provides compositions prepared according to this invention. These lubricant compositions display excellent lubricity, are solutions (all material is solubilized), and meet or exceed EC/1999/45 bio-no-tox criteria. SYNALOX™ 100-30B and SYNALOX™ 100-20B are commercially available PAGs for the engine lubricant market.

TABLE 1

| Component | Example 1 | Example 2 | Example 3 |
|---|---|---|---|
| SYNALOX ™ 100-30B | 86.37 | 86.91 | 0 |
| SYNALOX ™ 100-20B | 9.60 | 9.66 | 0 |
| SYNALOX ™ OA60 | 0 | 0 | 96.2 |
| LUVODUR ™ PVU-A | 0.05 | 0 | 0 |
| N-phenyl-alpha-naphtylamine | 0.48 | 0.48 | 0.50 |
| Reaction product of N-phenyl-aniline and 2,4,4-trimethylpentene | 0.58 | 0.58 | 0.50 |
| 6,6'-di-tert-butyl-2,2'-methylene-di-p-cresol | 0.48 | 0.29 | 0.40 |
| Phenothiazine | 0.38 | 0.2 | 0.50 |
| IRGAMET ™ 39 | 0.10 | 0.1 | 0.10 |
| Morpholine | 0.10 | 0.1 | 0.05 |
| Ester of polyaspartic acid (DESMOPHEN ™ NH 1420, from Bayer Material Science AG) | 0.48 | 0.29 | 0.30 |
| Triphenyl-thio-phosphate | 0.91 | 0.92 | 1.05 |
| Dibenzyl-disulfide | 0.48 | 0.48 | 0.4 |

These compositions, when tested for their lubricant properties, possess excellent lubricity. The additive packages are soluble in the PAGs, meet EC/1999/45 bio-no-tox criteria and do not deteriorate the bio-no-tox properties of the lubricant oil base stock (PAG) below the EC/1999/45 bio-no-tox criteria. Example 2, when subjected to EC/1999/45 bio-no-tox testing, has a Daphnia ($EL_{50}$) rating of 138 milligrams per liter (mg/L), an Alga ($EL_{50}$) rating of greater than 100 mg/L and a biodegradability (per Organization for Economic Co-operation and Development (OECD 301 F)) of more than 60 percent. Per EC/1999/45 $EL_{50}$ ratings in excess of 100 mg/L are rated as "low toxicity" and>60 percent biodegradability equates to "readily biodegradable".

Table 2 below shows viscosity information and Schwingungs-Reibverschleiß-Prüfgerät (SRV) tribology data using an Optimal Instruments device and amplitude of oscillation (x) of 1 millimeter (mm) and 2 mm in terms of Newtons (N) and megapascals (MPs) for Examples 2 and 3 as well as for a commercial (Castrol) 5W-30 motor oil prior to any engine testing.

TABLE 2

| | ASTM 445 Viscosity (Centistokes) | | | SRV, O.K-Load Temp = 135 C. (ASTMD7421-08) | | | |
|---|---|---|---|---|---|---|---|
| Lubricant | @ 40° C. | @ 100° C. | VI | (x = 1 mm) (N) | MPa | (x = 2 mm) (N) | MPa |
| Castrol 5W-30 | 65.5 | 11.5 | 172 | >800 | 2801 | 700 | 1602 |
| Example 2 | 45.0 | 8.7 | 174 | 800 | 2901 | 1600 | 3656 |
| Example 3 | 66.2 | 9.9 | 133 | 900 | 3017 | 1300 | 3016 |

The lubricant compositions of Examples 2 and 3 are expected to perform at least as well as the commercial 5W-30 motor oil in extended engine testing.

Table 3 below shows additional PAG compositions (Examples 4-12, Example 5 being a comparative example (CEx)) containing an additive package as described above. Table 3 also shows the results of a polyglycol ICOT test (in hours) for each of Examples (Ex) 4-12. In Table 3, WA D46-4 is a PAG made available by The Dow Chemical Company under the Tradename TERRALOX™ WA-46 (1,4-butanediol initiated (18 wt percent) extended with 64 wt percent ethylene oxide (EO) and 18 wt percent propylene oxide (PO) in mixed feed) to a number average molecular weight (Mn) of 664 Daltons, and PPG 32-2 is a PAG made available by Clariant under the Tradename B01/20 (Butanol initiated and extended with PO to Mn of 900 Daltons). The ICOT test is described in "Test d'oxydation catalysé par l'acétyle acétonate de fer (ICOT), Groupe Français de Coordination (GFC), Le Consulat, 147, ay. Paul Doumer, F-92852 Rueil-Malmaison, gfc@gfc-tests.org; see also IP48/97 (2004), Determination of oxidation characteristics of lubricating oil."

TABLE 3

| Component | CEx. 4 | CEx. 5 | CEx. 6 | Ex. 7 | Ex. 8 | Ex. 9 | Ex. 10 | Ex. 11 | Ex. 12 |
|---|---|---|---|---|---|---|---|---|---|
| WA D46-4 | | X | X | | X | | X | X | |
| PPG 32-2 (GH6-32) | X | | | X | | X | | | X |
| ICOT [hours] | 75 | 40 | 75 | 96 | >96 | 85 | >130 | 75 | 65 |
| Polyanilin | 0.05 | | | 0.05 | | | | | 0.05 |
| Na-salt of polyaspartic acid Baypure DS 100 "fest G" | 0.05 | — | 0.1 | — | — | — | — | — | — |
| $NH_3$-salt of polyaspartic acid Bay-pure DS 100/40 | | — | | 0.05 | 0.1 | 0.05 | 0.3 | 0.3 | 0.3 |
| Urea | 0.1 | — | — | 0.5 | 0.1 | 0.1 | 0.1 | — | — |
| Tetraurea (Oligo-urea (tetra-/octomer) ADDITIN M 10.411 (RheinChemie) | — | — | — | — | 0.1 | — | — | — | 0.1 |
| N-Phenyl-α-Naphtylamine RC7130 | 1.0 | — | 1.0 | 1.0 | — | — | — | — | — |
| N-Phenyl-1,1,3,3-tetramethylbutyl-naphtaline-1-amine | | | | 1.0 | 1.0 | 1.0 | | | |
| 6,6'-Di-tert-butyl-2,2'-methylenedi-p-cresol | | | | | 1.0 | 1.6 | | | |
| 2,2,4 Trimethyl-1,2-Dihydroquinolin | — | — | — | — | — | — | — | 1.5 | 1.25 |

TABLE 3-continued

| Component | CEx. 4 | CEx. 5 | CEx. 6 | Ex. 7 | Ex. 8 | Ex. 9 | Ex. 10 | Ex. 11 | Ex. 12 |
|---|---|---|---|---|---|---|---|---|---|
| Aniline, N-Phenyl, reaction product with 2,4,4-trimethylpentene (Vanlube ™ VL/SS, L57) | — | 1.0 | 1.0 | — | 1.0 | — | 1.0 | — | — |
| Phenothiazine | — | — | — | — | — | — | 2.0 | — | — |
| Triphenyl-thiophosphate, (Irgalube ™ TPPT) | — | 0.8 | 0.8 | — | 0.8 | — | 0.8 | — | 0.8 |

CEx 5, a comparative example, uses no polyaspartic acid salt and shows the least stabilization from among the additives used in Table 3. Ex 10 surprisingly provides stabilization of the lubricant composition sufficient to enable approximately a 40,000 kilometer driving cycle before an oil change would be needed. The polyaspartic acid derivatives appear to serve as acid scavengers, but do not appear to alter extreme pressure/anti-wear properties of the PAGs.

Further modifications and alternative embodiments of this invention will be apparent to those skilled in the art in view of this description. Equivalent elements or materials may be substituted for those illustrated and described herein.

What is claimed is:

1. A method of lubricating an automobile engine, which method comprises using to lubricate the engine a lubricant composition comprising: (A) at least one polyalkylene glycol suitable for use as a lubricant in an automotive engine, and (B) an additive package which comprises an acid scavenger, wherein the acid scavenger is an aspartic or polyaspatic acid ester, wherein the lubricant composition is useful for automotive engines.

2. A lubricant composition comprising:

(A) at least one polyalkylene glycol suitable for use as a lubricant in an automotive engine,and (B) an additive package which comprises an acid scavenger, wherein the acid scavenger is an aspartic or polyaspartic acid ester, wherein the lubricant composition is useful for automotive engines wherein the acid scavenger is a polyaspartic acid ester.

3. The lubricant composition of claim 2, wherein the acid scavenger is a compound of structure:

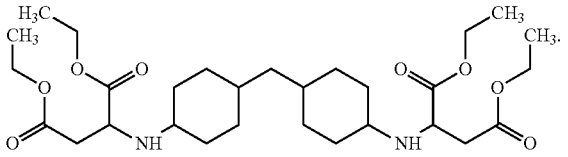

4. The lubricant composition of claim 2, wherein the additive package further comprises (i) at least one extreme pressure anti-wear additive, or (ii) at least one anti-corrosion additive, or (iii) at least one antioxidant, or (iv) at least one friction modifier, or (v) at least one additional acid scavenger, or (vi) any combination of (i)-(v).

5. The lubricant composition of claim 2, wherein the wherein the additive package is soluble at 25 degrees Centigrade in the polyalkylene glycol.

6. The lubricant composition of claim 2, wherein the additive package meets bio-no-tox criteria of European Community directive EC/1999/45 and does not deteriorate the bio-no-tox properties of the polyalkylene glycol to a point where the composition does not meet such criteria.

7. A process for manufacturing the lubricant composition of any of claims 2 or 3, which method comprises admixing the at least one polyalkylene glycol and the additive package.

* * * * *